United States Patent [19]

Ferguson

[11] Patent Number: 4,841,879

[45] Date of Patent: Jun. 27, 1989

[54] FOUR-WAY SKELETON PALLET

[76] Inventor: Stewart Ferguson, P.O. Box 376, Pacific Beach, Wash. 98571

[21] Appl. No.: 218,746

[22] Filed: Jul. 13, 1988

Related U.S. Application Data

[63] Continuation-in-part of Ser. No. 486,585, Apr. 19, 1983.

[51] Int. Cl.[4] ..... B65D 19/00

[52] U.S. Cl. ..... 108/51.1; 108/56.1

[58] Field of Search ..... 108/51.1, 52.1, 56.1, 108/56.3, 57.1; 206/599, 600; 249/542, 647

[56] References Cited

U.S. PATENT DOCUMENTS

| | | | |
|---|---|---|---|
| 3,131,655 | 5/1965 | Sellers | 108/51.1 |
| 3,176,632 | 4/1965 | Yinguing | 108/56.1 X |
| 3,301,200 | 1/1967 | Landsiedez | 108/56.1 |
| 3,469,542 | 9/1969 | Ahlenius | 108/56.1 |
| 3,927,624 | 12/1975 | Hewson | 108/56.1 |
| 4,184,435 | 1/1980 | Schevchenko | 108/57.1 |
| 4,292,899 | 10/1981 | Steffen | 108/51.1 |

FOREIGN PATENT DOCUMENTS

| | | | |
|---|---|---|---|
| 1938662 | 4/1971 | Fed. Rep. of Germany | 108/56.1 |
| 722621 | 1/1955 | United Kingdom | 108/51.1 |
| 847036 | 9/1960 | United Kingdom | 108/56.1 |

*Primary Examiner*—Kenneth J. Dorner
*Assistant Examiner*—José V. Chen
*Attorney, Agent, or Firm*—Robert W. Beach; Ward Brown

[57] ABSTRACT

The stringers of two sets of stringers crossing orthogonally to form a skeleton stringer pallet have edge forkway notches, ends of which notches are formed by crossing stringers so that the upright faces of such crossing stringers serve as a guide for the prong of a forklift inserted into the forkway notches.

10 Claims, 2 Drawing Sheets

Fig.1.
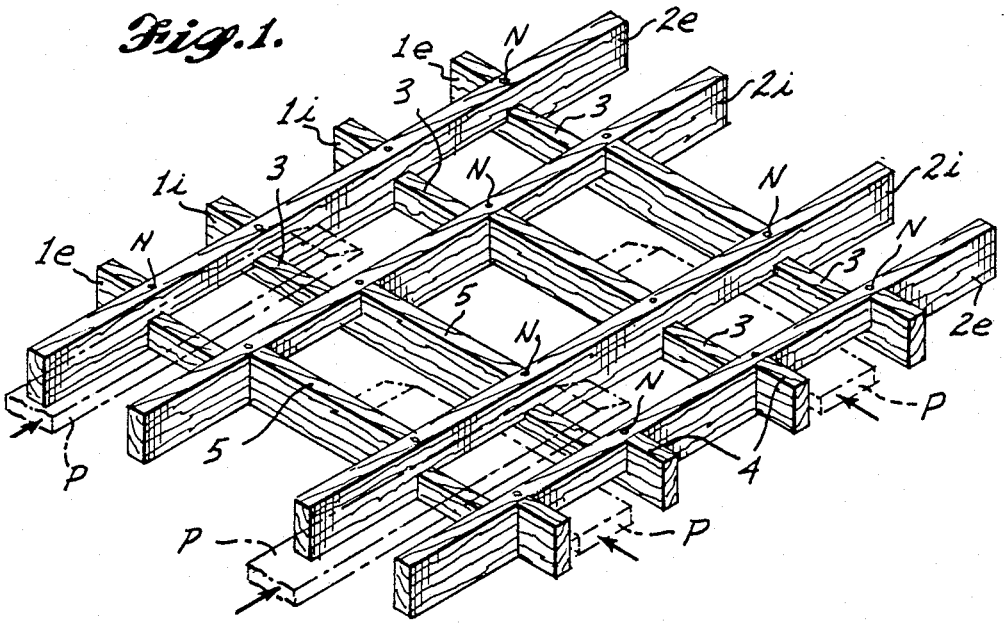
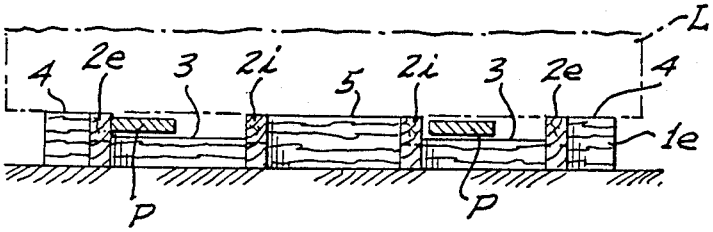
Fig.2.
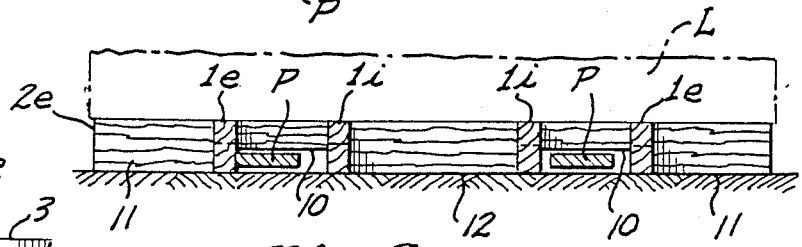
Fig.3.
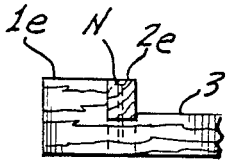
Fig.6.
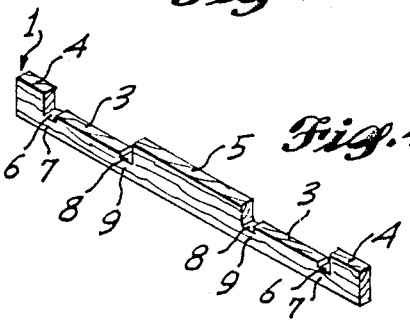
Fig.4.
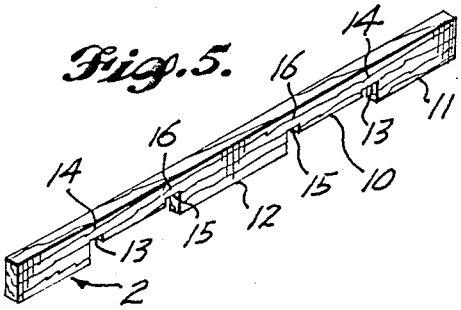
Fig.5.

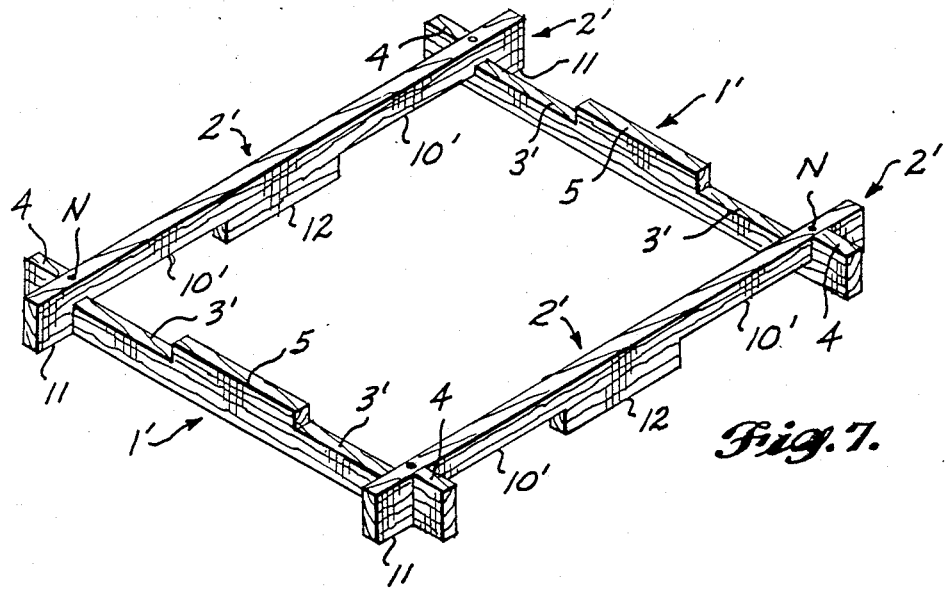
Fig. 7.
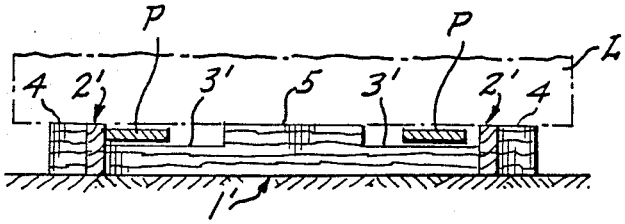
Fig. 8.
Fig. 9.
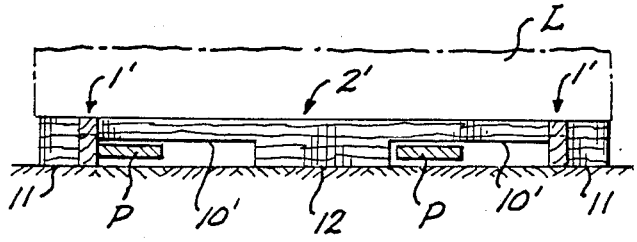
Fig. 10.
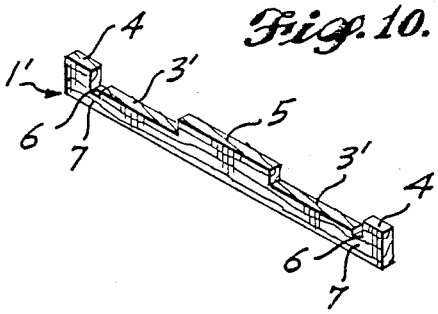
Fig. 11.
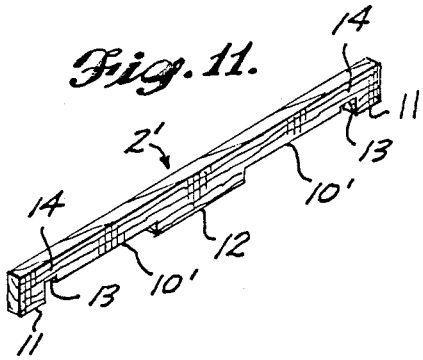

FOUR-WAY SKELETON PALLET

CROSS REFERENCE

This patent application is a continuation-inpart of my pending application Ser. No. 486,585, filed Apr. 19, 1983 for Skeleton Four-Way Pallet.

BACKGROUND OF THE INVENTION

1. Field of the Invention

This application relates to a four-way skeleton pallet that is composed of stringers rather than having a platform and which stringers have edge notches forming forkways extending orthogonally through the pallet for forklift prongs.

2. Prior Art

The Ahlenius U.S. Pat. No. 3,469,542, issued Sept. 30, 1969, discloses a pallet having orthogonal forkways extending through it and is composed of boards or stringers, but the structure of such pallet has disadvantages that are overcome by the pallet of the present invention.

FIG. 9 is the Shevchenko U.S. Pat. No. 4,184,435, issued Jan. 22, 1980, shows another type of forkway for pallets, but this pallet is essentially a platform surface type of pallet rather than being a skeleton stringer type of pallet.

SUMMARY OF THE INVENTION

A principal object of the present invention is to provide a light, strong and rugged skeleton stringer pallet which is very economical to manufacture, capable of being assembled quickly and easily and which also can be dismantled or disassembled readily for repair, or for its stringer components to be returned compactly to a source of shipment or salvaged for general purpose utilization.

It is especially an object to provide such a skeleton stringer pallet which can be picked up by a forklift quickly and easily while minimizing risk of damaging the pallet.

In particular, it is an object to provide a pallet which can be picked up by a forklift reliably on the first attempt without requiring that the prongs of the forklift be inserted in a precise location in the forkway to avoid damaging the pallet.

The foregoing objects can be accomplished by a reversible skeleton stringer pallet composed of two sets of stringers connected in orthogonal crossed relationship by notched joints and the stringer edges having forkway notches, the end of at least one forkway notch receiving a crossing stringent so that an upright face of such crossing stringer forms an end of the forkway notch.

BRIEF DESCRIPTION OF THE DRAWINGS

FIG. 1 is a top perspective of a representative form of rectangular skeleton stringer pallet.

FIG. 2 is an end elevation of the skeleton stringer pallet.

FIG. 3 is a side elevation of the skeleton stringer pallet.

FIG. 4 is a top perspective of a stringer of one set of stringers and FIG. 5 is a top perspective of a stringer of the other set of stringers of which the pallet is composed.

FIG. 6 is a fragmentary enlarged elevation of intersecting portions of stringers of the two sets of stringers showing a notched joint between them.

FIG. 7 is a top perspective of a modified type of rectangular skeleton stringer pallet construction.

FIG. 8 is an end elevation of such modified type of pallet construction, and FIG. 9 is a side elevation of such modified type of pallet construction.

FIG. 10 is a top perspective of a stringer of one set of stringers, and FIG. 11 is a top perspective of a stringer of the other set of stringers, of which the pallet shown in FIGS. 7, 8 and 9 is composed.

DETAILED DESCRIPTION

The present invention relates to a skeleton stringer pallet as distinguished from a pallet having a face board or face boards forming one or both sides of a pallet and secured to or carried by stringers.

The pallet shown in FIGS. 1, 2 and 3 is of rectangular shape and composed of two sets of orthogonally crossing stringers, which stringers are of rectangular cross section and are arranged with their widths extending upright and their thicknesses extending horizontally. One set of stringers includes edge stringers 1e adjacent to opposite ends of the pallet and one or more intermediate stringers 1located between the edge stringers 1e and extending parallel to them. The other set of stringers includes two edge stringers 2*e* adjacent to opposite sides of the pallet and one or more intermediate stringers 2*i* located between and extending parallel to the edge stringers 2*e*.

Preferably, the stringers of the two sets are connected at their crossing locations by interfitted notched joints. Such notched joints can be of different types such as the various joints shown in my copending patent application Ser. No. 486,585, which application is incorporated in this application by reference, but preferably the notches are deeper so that the stringers of the two sets are disposed in substantially coplanar relationship as they are in the Ahlenius U.S. Pat. No. 3,469,542 referred to above. By utilizing such deep notch joint construction, the pallet is of minimum thickness.

A key feature of the structure of pallets according to the present invention is the provision of notches in the edges of stringers for providing forkways for prongs of forklifts in contrast to the construction utilized in my copending application Ser. No. 486,585 which provides for forkways without requiring notches in the stringers.

It is important to provide forkways to constitute a four-way pallet construction which can be handled conveniently by forklifts and which will be rugged. Such characteristics result primarily from the relationship between the forkway notches in the edges of a first set of stringers and the stringers of the other set of stringers so that the stringers of such other set can serve as prong guides along which forklift prongs can run easily and smoothly.

The notched configuration of a first set of stringers, one of which is shown in FIG. 4, and the notched configuration of the other set of stringers, one of which is shown in FIG. 5, is such that the notching provides the dual function of forming forkways in the assembled pallet shown in FIGS. 1, 2 and 3 and of enabling the stringers of the two sets to be joined by interfitting notched joints when the stringers have been assembled.

In FIG. 4, a stringer 1 of one set of stringers is shown as having upper and lower edge and having two forkway notches 3 in the same edge of such stringer spaced inward from the opposite ends of the stringer to leave edge projections 4 between such notches and the stringer ends, and which notches are separated by a central edge projection 5. Each of such notches is elongated lengthwise of the stringer and has two end portions and a central portion therebetween. The end portions of the forkway notches 3 closer to the ends of the stringer have in them depressions 6 leaving connecting necks 7. Also, the end portions of the forkway notches 3 nearer the center of the stringer may have notches 8 providing connecting necks 9. The widths of the notches 6 and 8 will be approximately equal to the thickness of the crossing edge stringers 2*e* and intermediate stringers 2*i* and such crossing stringers fit into the depressions formed by the notches 6 and 8 to provide notched joints interconnecting the two set of stringers.

A stringer 2 of the other set of stringers shown in FIG. 5 also has upper and lower edges and two forkway notches 10 in one of its edges which are spaced respectively from the ends of the stringer 2 to form edge projections 11 at opposite end portions of the stringer and the end portions of such notches closer to the center of the stringer are spaced apart by an edge projection 12. Such notches are also elongated lengthwise of the stringer and have two end portions and a central portion therebetween.

The end portions of the forkway notches 10 closer to the ends of the stringer are deeper than the central portions of such notches for forming depressions of a width approximately equal to the thickness of a crossing stringer leaving connecting neck portions 14. Similarly, the end portions of the forkway notches 10 nearer the center of the stringer are deeper than the central portions of such notches and form depressions 15 of a width approximately equal to the thickness of the portion of the crossing stringer received in such notches leaving connecting neck portions 16.

When a set of stringers 1 as shown in FIG. 4 and a set of stringers 2, such as shown in FIG. 5, are assembled in crossing relationship, as shown in FIGS. 1, 2 and 3, with the forkway notches in the edges of the two sets of stringers opening oppositely, the necks 7 of the edge stringers 1e will be fitted into the depressions 13 in the stringers 2*e* and 2*i* and at the same time the necks 14 of the stringers 2*e* and 2*i* will be fitted into the depressions 6 of the stringers 1e and 1*i* to form notched joints at the intersections of the stringers. Simultaneously, the necks 9 of the stringers 1e and 1i will fit into the notches 15 of the stringers 2*e* and 2*i* and the necks 16 of the stringers 2*e* and 2*i* will fit into the notches 8 of the stringers 1*e* and 1*i* . In each instance, it is desirable for the necks to fit snugly into the depressions to minimize racking of the pallet.

While, as mentioned above, various types of notched joints such as shown in my copending patent application Ser. No. 486,585 could be used, it is preferred that the necks 7 and 9 and the necks 14 and 16 be approximately half of the depth of the stringers and that the deeper end portions of the forkway notches forming the depressions 6, 8, 13 and 15 be approximately one-half the depth of the stringers. The central portions of the forkway notches 3 and 10 will therefore be less than one-half the depth of the stringers.

While the stringers 1 and 2 can be of different dimensions, it is preferred that their depths be greater than their horizontal thicknesses. An economical type of lumber that can be used for the stringers is normally 2 inches (5.08 cm) thick horizontally and 4 inches (10.16 cm) deep. Usually planed lumber will be used for such stringers which actually will be $1\frac{1}{2}$ inches to $1\frac{5}{8}$ inches (3.81 cm to 4.11 cm) in thickness and $3\frac{1}{2}$ inches to $3\frac{5}{8}$ inches (8.89 cm to 9.19 cm) in depth. Under such circumstances, the deeper end portions of the forkway notches may be $1\frac{3}{4}$ inches (4.45 cm) and the depth of the shallower portions of the forkway notches may be $1\frac{1}{2}$ inches (3.81 cm). In other words, the depth of the depressions 6, 8, 13 and 15 below the central portions of the forkway notches will be $\frac{1}{4}$ 4 inch (0.64 cm).

It will be seen from FIGS. 1 and 2 that when the two sets of stringers are assembled in orthogonally crossing relationship, the edge stringers 2e have their necks 14 fitted in the depressions 6 of the stringers 1*e* and 1*i* so that the inner upright faces of the two crossing stringers 2*e* form the outer ends of the forkway notches 3 enabling such upright faces to serve as guides for a forklift prong inserted into a notch 3, as shown at the left of FIG. 2. The forklift prong P can slide along the right face of the left crossing pallet edge stringer 2*e* without encountering any obstruction.

Correspondingly, the edge stringer 2*e* shown at the right of FIG. 2 forms the right end of the right forkway notch 3 so that, if the forklift prongs P were moved to the right, the right prong could engage the left upright face of the right crossing stringer 2*e*.

Further, as shown in FIG. 2, the necks 14 and 16 of the right intermediate stringer 2*i* are received in the depressions 8 of the stringers 1*e* and 1*i* at the left ends of the right forkway notches 3 so as to provide a smooth upright face forming the left ends of such right forkway notches. Correspondingly, the necks 14 and 16 of the left intermediate stringer 2*i* are fitted into the depressions 8 of the stringers 1e and 1*i* so as to form the right ends of the left forkway notches 3.

It is preferred that the extent of the forkway notches 3 between the crossing stringers 2*e* and 2*i* be of a width considerably greater than the width of a forklift prong P so that the prongs can be inserted readily into the forkway notches without requiring a precision fit. The widths of the forkway notches and their locations can be such with respect to the spacing of the prongs P of a forklift that such prongs can engage either one of the crossing edge stringers 2*e* but can never engage one of the intermediate stringers 2*ii*, or the stringers 2i can be spaced farther apart and the edge stringers 2*e* can be spaced farther apart with respect to the spacing of forklift prongs P so that such prongs can engage one or the other of the intermediate stringers 2*i* but can never engage either of the edge stringers 2*e*.

Similarly, in FIG. 3, the downwardly opening forkway notches 10 are shown as being located so that a left prong P could engage the left edge stringer 1e or, if the forklift prongs were shifted to the right, the right prong P could engage the right edge stringer 1*e*, but neither forklift prong could ever engage either of the intermediate stringers 1*i*. Alternatively, the stringers 1*i* could be spaced farther apart and the stringers 1*e* could be spaced farther apart so that a forkway prong could engage either of the intermediate stringers 1*i* but could never engage either of the edge stringers 1*e*.

The two sets of crossing stringers 1 and 2 could be held in their crossed relationship by connecting crossing stringers at the location of some or all of the notched joints by connecting pins such as nails N or screws. If screws are used, they could perhaps be removed more readily to disassemble or dismantle the pallet into its stringer components for return shipment in compact form and reassembly into pallets or for general utilization as salvage.

In FIG. 2 the forkway notches 3 of the stringers 1 open upwardly, whereas the forkway notches 10 of the stringers 2 shown in FIG. 3 open oppositely, that is, downwardly. The pallet is reversible so that if the pallet were flipped side for side, the forkway notches 10 of stringers 2 would open upwardly and the forkway notches 3 of stringers 1 would open downwardly.

The modified skeleton stringer pallet shown in FIGS. 7, 8 and 9 differs from that shown in FIGS. 1, 2 and 3 principally in that the modified pallet is composed solely of edge stringers and does not include intermediate stringers between such edge stringers. One set is composed of edge stringers 1' of the type shown in FIG. 10, and the other set is composed of edge stringers 2' of the type shown in FIG. 11.

As shown in FIG. 10, each stringer 1' has a pair of forkway notches 3' spaced from the opposite ends of the stringer to provide edge projections 4 between the notches and the ends of the stringers, as discussed in connection with the stringer 1 shown in FIG. 4. The portions of such forkway notches adjacent to the ends of the stringer are cut deeper to provide depressions 6 for forming necks 7, again as discussed in connection with FIG. 4. The forkway notches of the stringer 1' shown in FIG. 10 differ from the forkway notches 3 of the stringer 1 shown in FIG. 4 in that the end portions of the forkway notches 3' closer to the center projection 5 do not have deeper portions forming depressions like the depressions 8 of the pallet 1 shown in FIG. 4.

Similarly, the modified stringers 2' shown in FIG. 11 have forkway notches 10' with deeper portions 13 in their end portions adjacent to the end projections 11 as in the stringer 2 of FIG. 5. The forkway notches 10' of the stringer 2', however, do not have deeper portions adjacent to the central projection 12 corresponding to the depressions 15 of the stringer 2 shown in FIG. 5.

When the two sets of edge stringers 1' and 2' are assembled in orthogonal relationship as shown in FIGS. 7, 8 and 9, the lower forkway notches 10' in the bottom edges of stringers 2' form one forkway and the forkway notches 3' in the upper edges of the stringers 1' form another forkway in orthogonal relationship to the forkway formed by the notches 10'. This pallet also is reversible so that if it is flipped side for side, the notches 3' will form a lower forkway and the notches 10' will form an upper forkway.

In this modified type of pallet, the forkway noches 3' will be located and spaced apart a distance such that the crossing stringers 2', as shown in FIG. 8, will be spaced apart a distance greater than the spacing of the forkway prongs P. The lengths of such forkway notches 3' will be great enough, however, to prevent a forklift prong P from engaging the end of either notch 3' closer to the center of the stringer 1'.

Correspondingly, as shown in FIG. 9, the location and width of the forkway notches 10' is such with respect to the width and spacing of the forklift prongs P that a prong may engage either of the crossing stringers 1' when the prongs are engaged in the notches 10', but neither of the prongs can engage an end of a forkway notch closer to the center of the stringer 2'. In the modified pallet construction shown in FIGS. 7, 8 and 9, as in the pallet construction shown in FIGS. 1, 2 and 3, a forklift prong P can engage and slide smoothly along an upright face of a stringer 2' when inserted into the forkway formed by the forkway notches 3', as shown in FIG. 8 or an upright face of a stringer 1' when the forklift prongs are inserted into the forkway notches 10' of the stringers 2', as shown in FIG. 9.

I claim:

1. A skeleton stringer pallet comprising two sets of stringers crossing orthogonally, one of the stringers of a first set of stringers having upper and lower edges and one of said edges having a forkway notch therein which is elongated lengthwise of said one stringer and has two end portions and a central portion therebetween, a crossing stringer of the other set of stringers being received in one of said end portions of said forkway notch so that an upright face of said crossing stringer is exposed to the central portion of said forkway notch and said upright face serves as a guide for a forklift prong inserted into said central portion of said forkway notch.

2. The pallet defined in claim 1, in which the crossing stringer constitutes an edge stringer of the pallet.

3. The pallet defined in claim 1, in which the end portion of the forkway notch in which the crossing stringer is received is deeper than the central portion of such notch and forms a depression of a width approximately equal to the thickness of the portion of the crossing stringer received in such notch and the crossing stringer fits into said depression for formings a notched joint.

4. The pallet defined in claim 1, in which each set of stringers includes two spaced pallet edge stringers and an intermediate stringer located between and parallel to said pallet edge stringers and said intermediate stringer being received in the other end portion of the forkway notch.

5. The pallet defined in claim 1, in which each set of stringers includes two spaced pallet edge stringers and two intermediate stringers located between and parallel to said pallet edge stringers, one of said intermediate stringers being received in the other end portion of the forkway notch.

6. The pallet defined in claim 1, in which such one edge of such one of the stringers has a second forkway notch spaced from the first forkway notch, elongated lengthwise of such stringer and having two end portions and a central portion therebetween, the crossing stringer being an edge stringer of the pallet received in an end portion of one of the two forkway notches, and a further crossing stringer, which also constitutes a pallet edge stringer, being received in an end portion of the other of the forkway notches.

7. The pallet defined in claim 6, in which each set of stringers includes two spaced pallet edge stringers and two intermediate stringers located between and parallel to said pallet edge stringers, each of said intermediate stringers being received in an end portion of one of the forkway notches.

8. A skeleton stringer pallet comprising two sets of stringers crossing orthogonally and having upper and lower edges, the upper edges of all of the stringers of a first set having two forkway notches therein which are elongated lengthwise of said stringers and each notch has two end portions and a central portion therebetween for forming a first forkway for forklift prongs and the lower edges of all the stringers of the other set of stringers having two forkway notches therein for forming a second forkway for forklift prongs extending orthogonally to said first forkway, a stringer of the other set of stringers crossing the stringers of the first set being received in one end portion of a forkway notch of the first set so that an upright face of said crossing stringer is exposed to the central portion of such forkway notch and said upright face serves as a guide for a forklift prong inserted into said central portion of said forkway notch.

9. The pallet defined in claim 8, in which the crossing stringer constitutes an edge stringer of the pallet.

10. The pallet defined in claim 8, in which the end portion of the forkway notch in which the crossing stringer is received is deeper than the central portion of such notch and forms a depression of a width approximately equal to the thickness of the portion of the crossing stringer received in such notch and the crossing stringer fits into such depression and forms a notched joint.

* * * * *